United States Patent [19]

Kicks

[11] Patent Number: 4,982,967

[45] Date of Patent: Jan. 8, 1991

[54] DARTBOARDS

[75] Inventor: Malcolm Kicks, Haverhill, England

[73] Assignee: Larrett Tungsten Dart Company LTD, Haverhill, England

[21] Appl. No.: 269,676

[22] Filed: Nov. 10, 1988

Related U.S. Application Data

[63] Continuation of Ser. No. 72,763, Jul. 13, 1987, abandoned.

[30] Foreign Application Priority Data

Jul. 14, 1986 [GB] United Kingdom ..... 8617096
Jan. 23, 1987 [GB] United Kingdom ..... 8701476

[51] Int. Cl.[5] ..... F41J 3/00
[52] U.S. Cl. ..... 273/408; 411/463; 411/477
[58] Field of Search ..... 273/408; 411/451, 456, 411/461, 462, 463, 477

[56] References Cited

U.S. PATENT DOCUMENTS

| | | | |
|---|---|---|---|
| 718,649 | 1/1903 | Morehouse | 411/461 |
| 890,240 | 12/1932 | Taylor | 411/461 |
| 1,647,934 | 11/1927 | Sallop | 411/477 X |
| 3,409,301 | 11/1968 | Studen | 273/408 |
| 3,628,843 | 5/1887 | Kerrison, Jr. | 411/456 |
| 4,220,070 | 9/1980 | Anstett | 411/456 X |
| 4,697,045 | 9/1987 | Beatty | 411/456 X |

FOREIGN PATENT DOCUMENTS

| | | | |
|---|---|---|---|
| 749142 | 5/1933 | France | 411/461 |
| 302765 | 12/1928 | United Kingdom | 411/461 |
| 2069854 | 9/1981 | United Kingdom | 273/408 |
| 2103497 | 2/1983 | United Kingdom | 273/408 |
| 2114902 | 9/1983 | United Kingdom | 273/408 |
| 2157184 | 10/1985 | United Kingdom | 273/408 |

*Primary Examiner*—Paul E. Shapiro
*Attorney, Agent, or Firm*—Nutter, McClennen & Fish

[57] ABSTRACT

A dartboard has bed-defining members which are held in position by prongs made from sheet material. The prongs may be formed into a U-shape and be adapted to straddle a bed-defining member or they may be made in one piece with a bed-defining member.

4 Claims, 2 Drawing Sheets

DARTBOARDS

This application is a continuation of application Ser. No. 072,763, filed July 13, 1987, now abandoned.

The invention relates to dartboards, and to fasteners for use thereon.

Quality dartboards are nowadays made from what is commonly termed bristles but consist of compressed sisal fibers. The playing or scoring areas of the board are known as beds and are delineated by radial and circular wires stapled to the sisal by U-shaped staples that straddle the bed-defining wires. The wires define a center circle (inner bull) around which there is an annulus (outer bull). From the outer bull, twenty equal sectors extend to a wire circle which is disposed near the periphery of the board and, together with another circle of wire, defines a doubles ring. A similar ring known as the trebles ring is mid-way between the doubles ring and the outer bull and defined by further circles of wire. Numbers identifying the scoring values of the twenty segments are usually also bent from wire and stapled to the board beyond the beds.

Conventionally, all the wire, including that from which the staples are manufactured, is made from round stock because this is the cheapest. However, as dart players will know, the dart points often strike the wire, hit the sisal board material very obliquely and "bounce off" to fall on the floor. This is annoying, especially in match play, but has been accepted as unavoidable in the past. Recently, experiments have taken place with bed defining radial and circular wires of quadrilateral cross section constructed and arranged as described and claimed in Application No. 8610011. In one trial by experts, it was found that, out of 18,333 throws, the number of bounce-offs was thereby reduced to as low as 46 and these 46 darts mostly bounced off the staples, which continue to be made from round stock. Such staples, whether used with conventional bed-defining wires of round stock or with the quadrilateral wires of the aforesaid Application, form pockets in which the dart points can become trapped, whereafter the darts fall to the ground.

The invention aims to improve the dartboard construction so that bouncing off is minimized still further.

According to one aspect of the invention, fasteners for holding down at least the radial bed-defining wires to the sisal fiber board are made as flat prongs from sheet material.

In one form of the invention, these prongs are bent to U-shape and individually straddle the radial wires as hitherto. However, the areas or pockets offered to dart points by these prongs to cause bouncing off are practically negligible. What is more, if, as is preferred, the radial bed-defining wires overlie the circular wires and one of the prongs holding down the radial wires is disposed within and of substantially the same width as the doubles ring and another or the other prong is disposed within and of substantially the same width as the trebles ring, then the number of fasteners required is less than the number of conventional staples hitherto needed. This represents a saving in material and labor and, of course, still less area will be offered to oncoming darts. Conventional boards require 65 staples if only the radial wires are stapled down, while the circumferential wires are held down by the overlying radials. With a board according to the invention, the number of straddling fasteners can be reduced to 40.

In another form of the invention, the radial wires are in the form of slender spokes of sheet material and the prongs are made in one piece with the spokes.

Examples of the invention will now be described with reference to the accompanying drawings, wherein.

Figure 1:
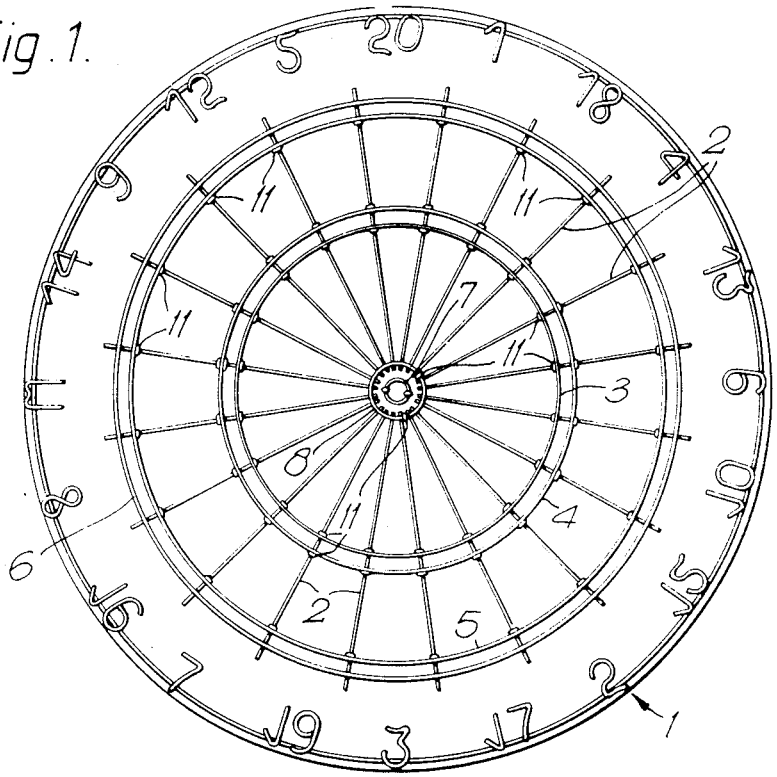
FIG. 1 is a plan view of a dartboard employing conventional staples.

Referring to FIG. 1, this shows a conventional round playing board 1 of compressed sisal fibers and, fixed thereto, radially extending wires 2 defining sector-shaped paying areas and circular wires 3,4,5,6,7, and 8. The wires 3,4 define an annulus which intersects the radial wires and is known as the trebles ring. A doubles ring is defined between circular wires 5 and 6. Wires 7 and 8 together define a ring known as the outer bull and the area within the wire 7 is known as the inner bull. When necessary, the wires are held to the board material by staples 11 of round wire. Usually, the staples are confined to holding down the radial wires 2 adjacent to each of the circular wires 3.4 and 5 and possibly also 8.

Figure 2:
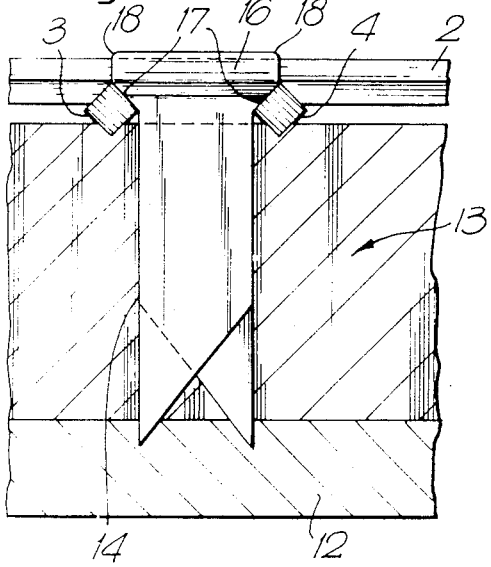
FIG. 2 is a fragmentary part-sectional enlarged side elevation of a dartboard according to the invention.

In the form of the invention according to FIG. 2, a chipboard backing 12 is provided for a layer of compressed sisal fibers 13 into which the circular wires such as 3 and 4 of quadrilateral cross section are embedded by one corner. The circular wires are held down by the radial bed-defining wires 2, which are likewise of quadrilateral cross section.

Figure 3:
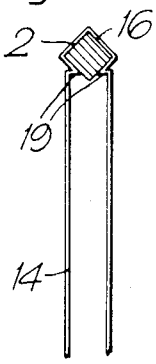
FIG. 3 is a part-sectional front elevation of the FIG. 2 construction showing one of the fasteners in place over a radial wire of quadrilateral cross section.

Each radial wire is fastened to the sisal material 13 by flat prongs 14 which may penetrate into backing 12. Each prong consists of sheet material, preferably metal, bent into substantially U-shape to straddle the radial wire 2, as best shown in FIG. 3. The prong is made from a strip which is pointed at its ends and has a mid-length enlargement 16 where it embraces the radial wire. The enlargement merges with the rest of the strip at four shoulders 17 which are designed to rest on the circular wires 3,4 or 5,6, as the case may be. It will be seen from FIG. 2 that, except at the enlargement 16, the strip material has a width corresponding to the space between circular wires, for example 5/16 inch, the width of the enlarged portion being approximately ⅜ inch. In this way, one can achieve a saving in the number of prongs as compared with conventional boards and the prongs assist in preventing displacement of the circular wires.

Figure 4:
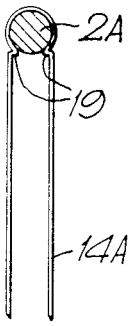
FIG. 4 is a part-sectional front elevation of the FIG. 2 construction showing one of the fasteners in place over a radial wire of round cross section.
Figure 5:
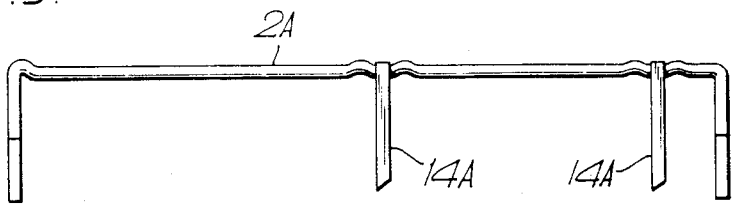
FIG. 5 is a side elevation of one of the radial wires of round cross section with two fasteners in place.

If, as is shown in FIG. 4, the radial bed-defining wires 2A are of round stock instead of quadrilateral in cross section, the staples 14A need not be enlarged at mid length. Instead, each radial wire 2A may be bent to form an emplacement for each flat prong 14A, this being shown in FIG. 5, which also indicates that the ends of the radial wires may be flanged in conventional manner to define spikes which are likewise embedded in the sisal material.

Figure 6:
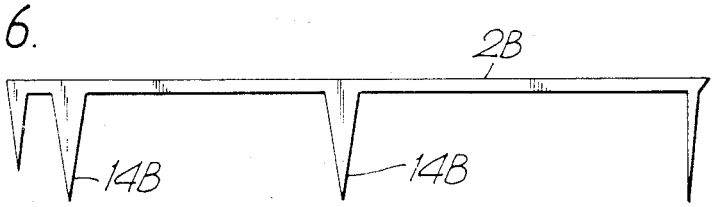
FIG. 6 is a side elevation of a radial wire according to a modified form of the invention.
Figure 7:
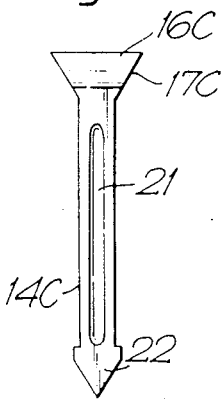
FIG. 7 is a side elevation of a modified fastener for wires of quadrilateral cross-section.
Figure 8:
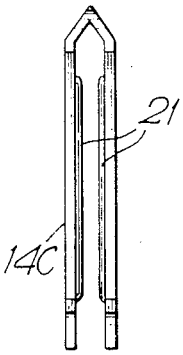
FIG. 8 is a front-elevation of the FIG. 7 fastener.
Figure 9:
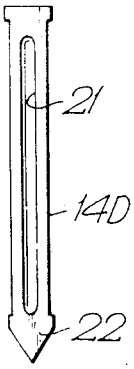
FIG. 9 is a view similar to FIG. 7 of another form of fastener for wires of round cross section.
Figure 10:
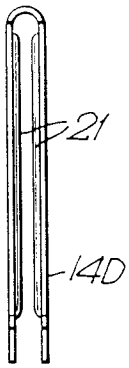
FIG. 10 is a front elevation of the FIG. 9 fastener.

In the modification of FIG. 6, the radial wire 2B is in the form of a slender spoke of sheet metal and the prongs are made in one piece with the spoke. Thus, there are prongs 14B to be disposed in the doubles and trebles rings and flat spikes at the ends of the spoke also for embedding in the sisal board.

The preferred material of the fasteners for boards according to the invention is hardened spring steel strip. The invention is applicable to sisal boards as well as boards of other material. In the FIG. 2 embodiment, the enlarged portions of the fasteners intermediate their ends are preferably provided with a radiused edge as shown at 18. The thickness of sheet material from which the fasteners are made is preferably 0.005 to 0.007 inch but, if the prongs are integral with the radial wires, a thickness of 1.6 mm is preferred.

In explanation, the radii 18 serve to provide a smooth finish and knit the fastener neatly over the radial wire. The shoulders 17 are intended to eliminate pockets in which the points of darts could be trapped. FIGS. 3 and 4 illustrate rebent portions 19 at the places where the fasteners embrace the radial wires. These rebent portions assist in gripping the radial wires but are optional. If desired, the strip material of the fasteners can be ribbed for strengthening purposes so that the prongs can be more easily pushed into the compressed sisal fibers 13 and the chipboard backing 12.

This feature is more clearly illustrated in FIGS. 7 to 10. Each of the fasteners of FIGS. 7 to 10 is again bent to substantially U-shape from a sheet metal strip to define flat two-legged prongs 14C or 14D. Each leg is formed with an impressed rib 21 for strengthening purposes. Further, as for the FIG. 2 embodiment, the strip from which the prongs are made is pointed at its ends but this time by way of sagittate formations 22, barbs or similar anchoring means which resist withdrawal of the fastener from the dartboard material. In the case of the FIGS. 7 and B fastener, there is again a mid-length enlargement 16C merging with the rest of the strip at shoulders 17C for the purpose hereinbefore described.

Although the invention has been described, by way of example, with reference to a particular embodiment it will be appreciated that variations and modifications may be made. For example, the legs of the prongs 14 that penetrate through the sisal into the backing may be corrugated.

I claim:

1. A compressed sisal fiber dartboard including a plurality of radially-extending members and a plurality of circularly-extending members constituting bed-defining members, the said members being arranged on a surface of the dartboard, the radially-extending members defining sector-shaped playing areas and overlying the circularly-extending members, and the circularly-extending members being arranged in pairs, each pair of circularly-extending members defining a respective annular playing area, and associated with the radially-extending members flat staples which extend into the dartboard, which enable a smooth face to be presented by the radially-extending members when the surface of the board is viewed and which hold the radially-extending members to the dartboard, each of the staples being positioned on the dartboard between a respective pair of circularly-extending members with its width parallel to the length of its associated radially-extending member and having a saddle portion which straddles that member, shoulders adapted to rest on the circularly-extending members between which the staple is positioned and leg portions which extend into the dartboard, the radially-extending members and the staples combining to hold the associated circularly-extending members in place.

2. A compressed sisal fiber dartboard including a plurality of radially-extending members and a plurality of circularly-extending members constituting bed-defining members, the said members being arranged on a surface of the dartboard, the radially-extending members defining sector-shaped playing areas and overlying the circularly-extending members, and the circularly-extending members being arranged in pairs, each pair of circularly-extending members defining a respective standard annular playing ring, and associated with the radially-extending members flat fastening means in the form of staples having leg portions which extend into the dartboard, which enable a smooth face to be presented by the radially-extending members when the surface of the board is viewed and which hold the radially-extending members to the dartboard, each of the staples having a saddle portion which straddles the associated radially extending member and engages the associated circularly-extending members and being positioned on the dartboard in a said ring between a respective pair of circularly-extending members with its width parallel to the length of its associated radially-extending member, coacting surfaces on each of the radially-extending members and each of the staples maintaining the associated pair of circularly-extending members defining a ring in fixed spaced relation against the dartboard surface.

3. A dartboard as defined in claim 2 including a longitudinally-extending strengthening rib in each leg of the staples.

4. A dartboard as defined in claim 2 wherein each leg of the staples terminates in a sagittate formation.

* * * * *